US006533537B1

(12) United States Patent
Nakada

(10) Patent No.: US 6,533,537 B1
(45) Date of Patent: Mar. 18, 2003

(54) IMPELLER FOR CIRCUMFERENTIAL CURRENT PUMP

(75) Inventor: Ryoichi Nakada, Kawaguchi (JP)

(73) Assignee: Enplas Corporation, Saitama (JP)

( * ) Notice: Subject to any disclaimer, the term of this patent is extended or adjusted under 35 U.S.C. 154(b) by 0 days.

(21) Appl. No.: 09/698,780

(22) Filed: Oct. 27, 2000

(30) Foreign Application Priority Data

Oct. 28, 1999 (JP) ..... 11-306717

(51) Int. Cl.[7] ..... F04D 5/00

(52) U.S. Cl. ..... 415/55.1; 415/106; 415/200; 416/241 A

(58) Field of Search ..... 415/55.1, 55.2, 415/55.3, 55.4, 55.5, 55.6, 55.7, 104, 106, 200; 416/241 A

(56) References Cited

U.S. PATENT DOCUMENTS 3,551,070 A * 12/1970 Glucksman ..... 416/241 A
4,451,213 A 5/1984 Takei et al.
4,477,228 A * 10/1984 Duffy et al. ..... 416/241 A
4,767,277 A * 8/1988 Buse ..... 416/241 A
5,409,357 A * 4/1995 Yu et al. ..... 415/55.1
5,952,747 A * 9/1999 Nakase ..... 310/43

FOREIGN PATENT DOCUMENTS

JP 7-151091 A * 6/1995 ..... 415/55.1

* cited by examiner

*Primary Examiner*—Christopher Verdier
(74) *Attorney, Agent, or Firm*—Bachman & LaPointe, P.C.

(57) ABSTRACT

An impeller for a circumferential current pump does not generate a weld phenomenon and can make a structure of an injection molding metal mold simple. An impeller (2) for a circumferential current pump (1) is provided with a plurality of vane grooves (12) on an outer periphery of a synthetic resin disc-like member (8) rotated by a motor (3*a*), and is rotatably received with a substantially disc-like space (6) formed between a pump casing (4) and a pump cover (5). An axial hole (15) engaging with a drive shaft (21) of the motor (3*a*) is formed in a center portion of the disc-like member (8), and a pressure adjusting groove (17) open to both side surfaces (10, 11) of the disc-like member (8) is formed in the axial hole (15). An annular recess portion (18) for arranging a ring gate (20) for injection molding is formed at a position a predetermined size apart from an outer peripheral side of the axial hole (15). The pressure adjusting groove (17) functions to keep a balance of a pressure applied to both side surfaces (10, 11) in the impeller (2).

10 Claims, 11 Drawing Sheets

IMPELLER FOR CIRCUMFERENTIAL CURRENT PUMP

BACKGROUND OF THE INVENTION

1. Field of the Invention

The present invention relates to an impeller of a circumferential current pump used as an in-tank type fuel pump of an automobile.

2. Description of the Prior Art

An in-tank type circumferential current pump having an improved property for being mounted to a vehicle and having a low noise and a small pressure change has been conventionally used in a fuel pump for an electronically controlled type fuel injection apparatus of an automobile.

FIGS. 17 to 19 show a circumferential current pump 51 for an automobile. The circumferential current pump 51 shown in these drawings is placed within a fuel tank (not shown), and is structured such as to apply an energy to a fuel by a vane 54 formed on an outer periphery of an impeller 52 when the impeller 52 is rotated by a motor 53 so as to increase a pressure of the fuel flowing into a pump flow passage 56 from a fuel inlet port 55 and discharge the fuel having the increased pressure to an engine side from a fuel discharge port 57.

In the circumferential current pump 51 mentioned above, in order to maintain a pump efficiency and a discharge pressure in a desired state, it is necessary to set gaps w1 and w2 in a side of side surfaces 58*a* and 58*b* of the impeller 52 within a predetermined size so as to reduce a leaked flow amount.

Further, in the circumferential current pump 51 mentioned above, in order to prevent one side surface 58*a* of the.impeller 52 from being pressed to a pump casing 60 and prevent another side surface 58*b* of the impeller 52 from being pressed to a pump cover 61 by maintaining the gaps w1 and w2 in the side of the side surfaces 58*a* and 58*b* of the impeller 52 in a suitable size, a pressure adjusting hole 62 open to both side surfaces 58*a* and 58*b* of the impeller 52 and communicating the gaps w1 and w2 in the side of both side surfaces 58*a* and 58*b* of the impeller 52 is formed. In the circumferential current pump 51 structured in this manner, a pressure balance in the side of both side surfaces 58*a* and 58*b* of the impeller 52 is achieved by the pressure adjusting hole 62, the impeller 52 smoothly rotates in a state of being a little apart from the pump casing 60 and the pump cover 61, and an abrasion of the side surfaces 58*a* and 58*b* of the impeller 52 is prevented, so that a size change caused by the abrasion of the side surfaces 58*a* and 58*b* of the impeller 52 is prevented and an improved pump function can be achieved for a long time.

Since the impeller 52 of the conventional circumferential current pump 51 mentioned above is always in contact with the fuel within the fuel tank, a phenol resin or a PPS resin excellent in a solvent resistance is used, whereby the impeller 52 is formed in a desired shape in accordance with an injection molding. Then, the pressure adjusting hole 62 of the impeller 52 mentioned above is formed by a pin 64 stood within a cavity 63 (refer to FIG. 20).

However, as shown in FIG. 20, when the pin 64 for the pressure adjusting hole 62 is at the position apart from an axial hole forming portion 65, a part of a molten resin flow 67 injected into the cavity 63 from an injecting gate 66 is brought into contact with the pin and branched and thereafter the molten resin flow 67 is combined in a downstream side of the pin 64, so that there is generated a disadvantage (a weld phenomenon) that a surface accuracy of the combined portion is deteriorated. Further, in the conventional structure mentioned above, since it is necessary to arrange a plurality of narrow pins 64 within the cavity and a structure of an injection molding metal mold 68 is complicated, the injection molding metal mold 68 becomes expensive, thereby preventing a producing cost of the impeller 52 from being reduced.

SUMMARY OF THE INVENTION

Accordingly, an object of the present invention is to provide an impeller for a circumferential current pump which can make a structure of an injection molding metal mold compact without generating a weld phenomenon.

In accordance with a first aspect of the present invention, there is provided an impeller for a circumferential current pump which is provided with a plurality of vane grooves in an outer peripheral side of a synthetic resin disc-like member rotated by a motor and is rotatably received within a substantially disc-like space formed between a pump casing and a pump cover. In this structure, an axial hole engaging with a drive shaft of the motor is formed in a center portion of the disc-like member and a pressure adjusting groove open to both side surfaces of the disc-like member is formed in the axial hole.

In accordance with the present invention having the structure mentioned above, the pressure adjusting groove formed in the axial hole functions so as to keep a balance of a pressure applied to both side surface side of the impeller. As a result, the impeller smoothly rotates in a state of keeping a little gap between the pump casing and the pump cover.

In accordance with a second aspect of the present invention, there is provided an impeller for a circumferential current pump as recited in the first aspect mentioned above, wherein an annular recess portion for arranging a ring gate for an injection molding is formed at a position a predetermined size apart from an outer peripheral side of the axial hole.

Since it is possible to receive a burr within the annular recess portion even when the burr is generated at a time of separating the ring gate for the injection molding, the surface accuracy of the impeller side surface is not deteriorated by the burr.

BRIEF DESCRIPTION OF THE DRAWINGS

FIGS. 4A and 4B are views for explaining an operating state of the circumferential current pump, in which FIG. 4A is a schematic plan view for explaining the operating state of the circumferential current pump and FIG. 4B is a cross sectional view along a line A—A in FIG. 4A;

DESCRIPTION OF THE PREFERRED EMBODIMENTS

A description will be in detail given below of embodiments in accordance with the present invention with reference to the accompanying drawings.

First Embodiment

Figure 1:
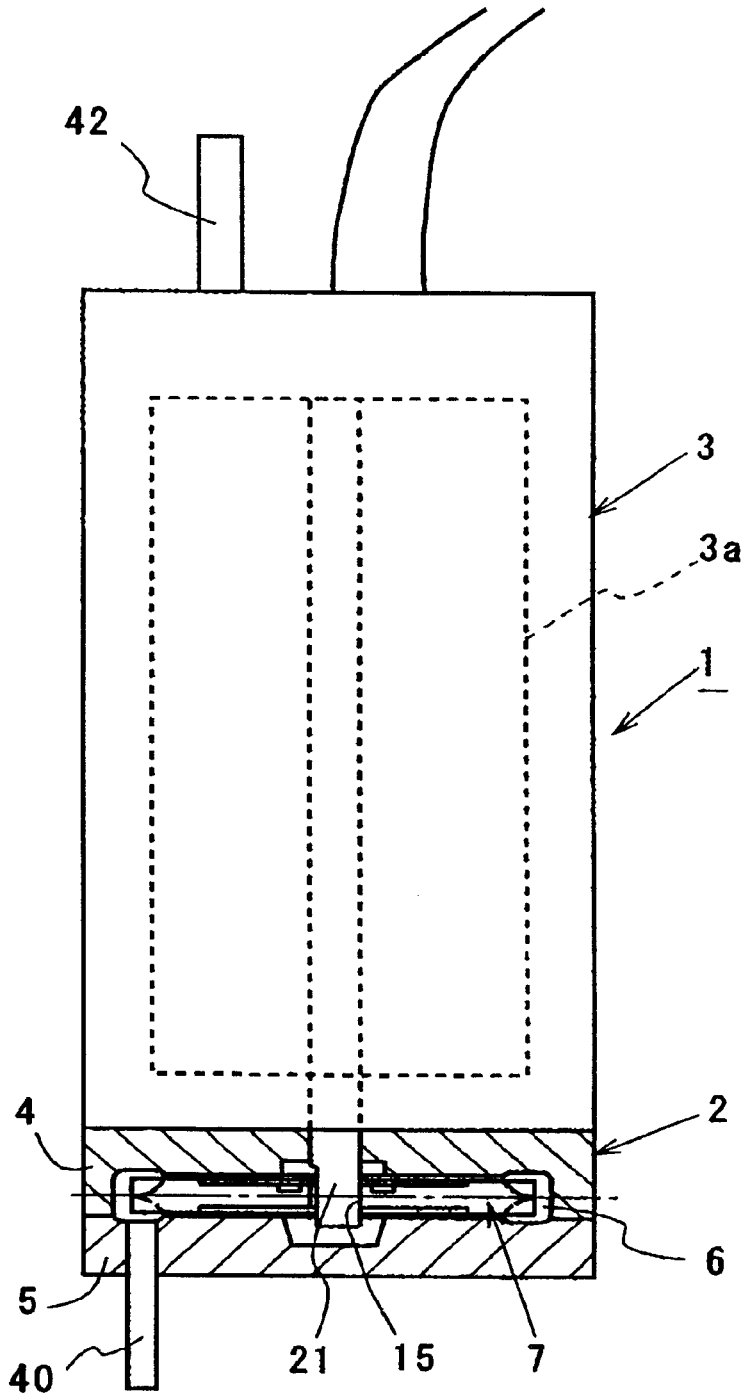
FIG. 1 is a front elevational view showing a part of a circumferential current pump in accordance with a first embodiment of the present invention in a broken manner.
Figure 2:
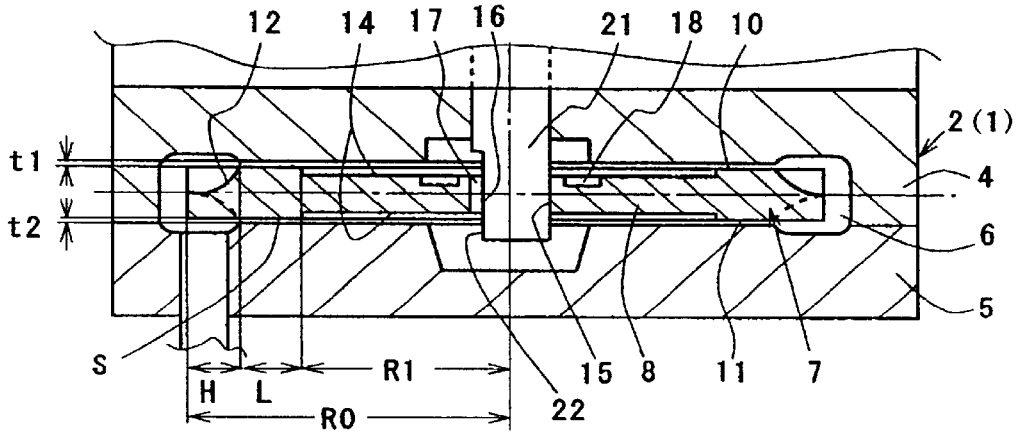
FIG. 2 is a view showing a part of FIG. 1 in an enlarged manner.

FIGS. 1 and 2 are views showing a circumferential current pump 1 in accordance with a first embodiment of the present invention. Among them, FIG. 1 is a front elevational view showing a part of the circumferential current pump 1 in a broken manner. Further, FIG. 2 is a cross sectional view showing a part of FIG. 1 in an enlarged manner.

As shown in these drawings, the circumferential current pump 1 in accordance with the present embodiment is constituted by a pump portion 2 and a motor portion 3. Among them, the pump portion 2 is provided with a pump casing 4 arranged in a lower end portion of the motor portion 3, a pump cover 5 assembled in a lower surface side of the pump casing 4, and a substantially disc-like impeller 7 rotatably received within a substantially disc-like space 6 formed between the pump casing 4 and the pump cover 5.

Since the impeller 7 is placed within a fuel tank (not shown), a phenol resin or a PPS resin excellent in a solvent resistance is used and the impeller 7 is formed in a desired shape in accordance with an injection molding.

The impeller 7 is structured such that a plurality of vane grooves 12 are formed in each of both side surfaces 10 and 11 in an outer peripheral end portion of a disc-like member 8 and vanes 13 between the vane grooves 12 and 12 are a half pitch shifted between one side surface 10 side and another side surface 11 side, as in detail shown in FIGS. 5 to 9. Further, a disc-like recess portion 14 having a predetermined radius around a center of rotation of the impeller 7 is formed in both side surfaces 10 and 11 of the impeller 7. Further, an axial hole 15 is formed in a center portion of the impeller 7, and a pressure adjusting groove 17 communicated with the recess portions 14 and 14 in both side surfaces 10 and 11 of the impeller 7 is formed in a rotation preventing portion 16 of the axial hole 15. This pressure adjusting groove 17 is structured such as to balance a pressure applied to both side surfaces 10 and 11 of the impeller 7 so as to enable the impeller 7 to rotate in a state of being a little apart from the pump casing 4 and the pump cover 5. Accordingly, the impeller 7 is not abraded by being pressed to the pump casing 4 or the pump cover 5, and smoothly rotates for a long time.

Figure 10:
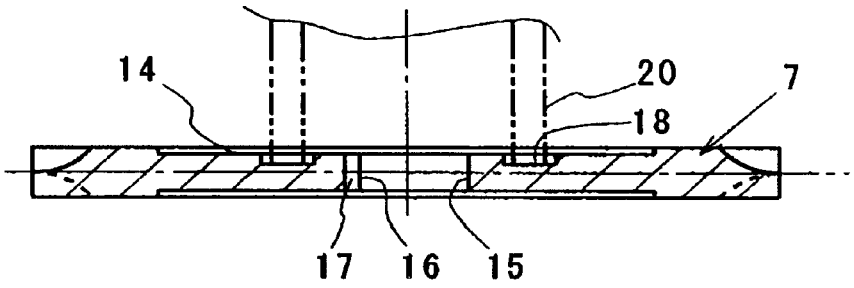
FIG. 10 is a cross sectional view showing a relation between the impeller and a ring gate (a cross sectional view along a line E—E in FIG. 11)
Figure 11:
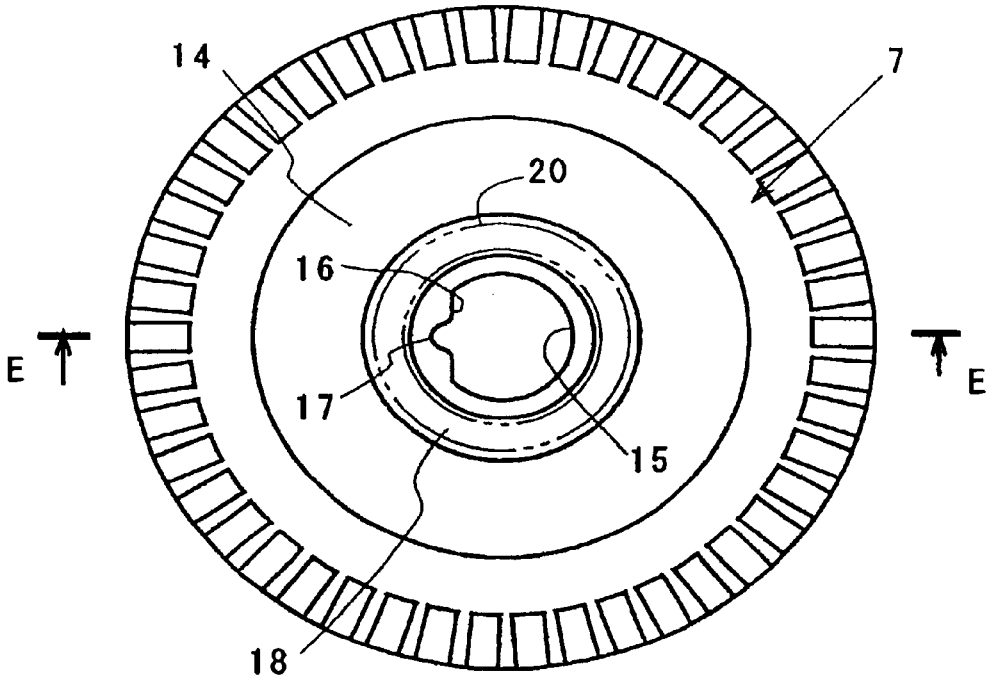
FIG. 11 is a plan view showing a relation between the impeller and the ring gate.
Figure 12:
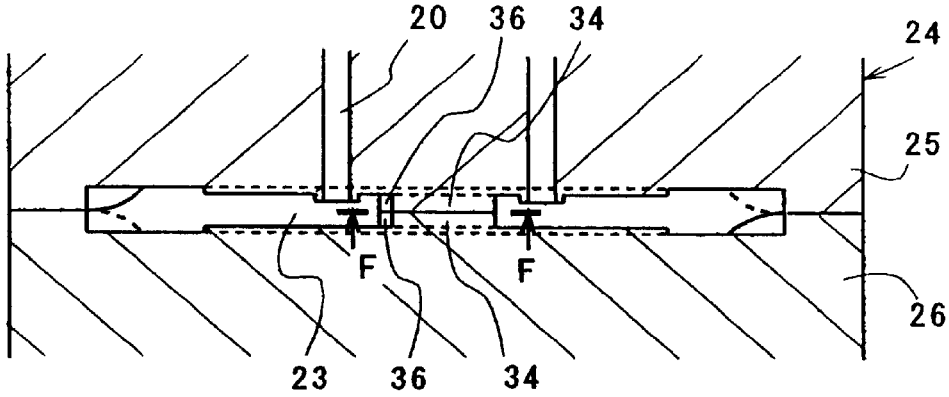
FIG. 12 is a cross sectional view showing a first example of an injection molding metal mold.

Further, an annular recess portion 18 is formed at a position a predetermined spacing apart from the axial hole 15 in the recess portion 14 in the side of one side surface 10 of the impeller 7. The annular recess portion 18 is structured such as to arrange the ring gate 20 for the injection molding, as shown in FIGS. 10 to 12. In this case, the predetermined size from the axial hole 15 means a size such as to secure a strength of a peripheral edge portion of the axial hole 15 and a size which is suitably changed in correspondence to a design condition of the impeller 7. Since a front end of the ring gate 20 is at a position deeper than the recess portion 14 of the impeller 7 as mentioned above, the burr and the surface roughness do not give a bad influence to the surface accuracy in the side of the side surface 10 of the impeller 7 even when the burr and the surface roughness are generated by separating the ring gate 20 from the impeller 7 after the injection molding is finished.

In this case, the rotation preventing portion 16 engages with a notch portion 22 of a drive shaft 21 so as to receive a drive force transmitted from the motor portion 3. Further, the vane groove 12 of the impeller 7 mentioned above is structured such that a shape in the side of the side surface and a shape in the side of the outer peripheral side are formed in a substantially rectangular shape and an inner end portion in a radial direction thereof is cut up so as to form a substantially circular arc shape.

Figure 15:
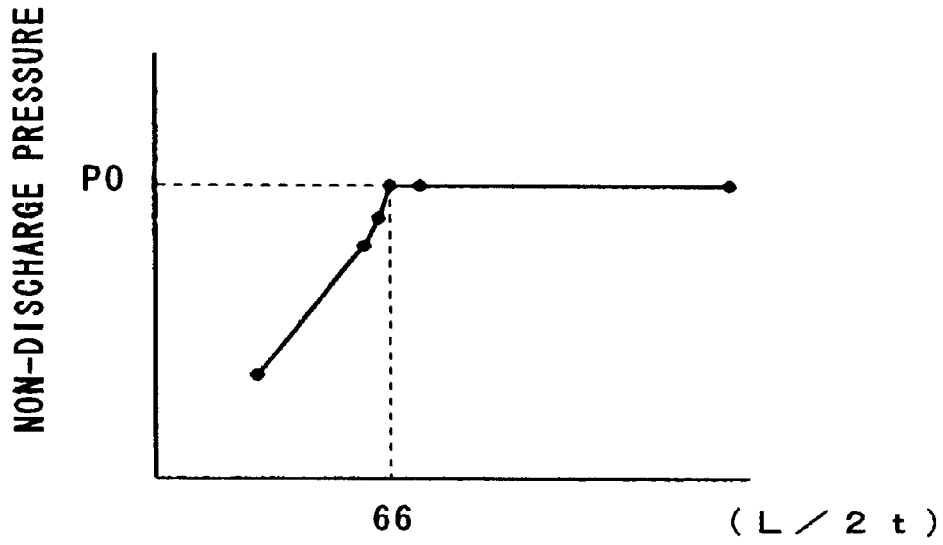
FIG. 15 is a graph showing a relation between a dimensionless amount (L/2t) and a no-discharge pressure.
Figure 16:
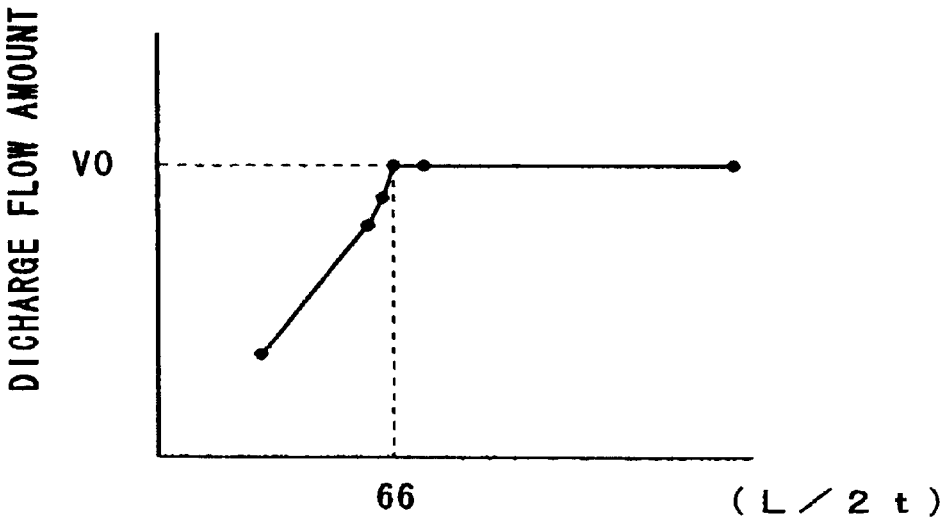
FIG. 16 is a graph showing a relation between the dimensionless amount (L/2t) and a discharge flow amount.
Figure 17:
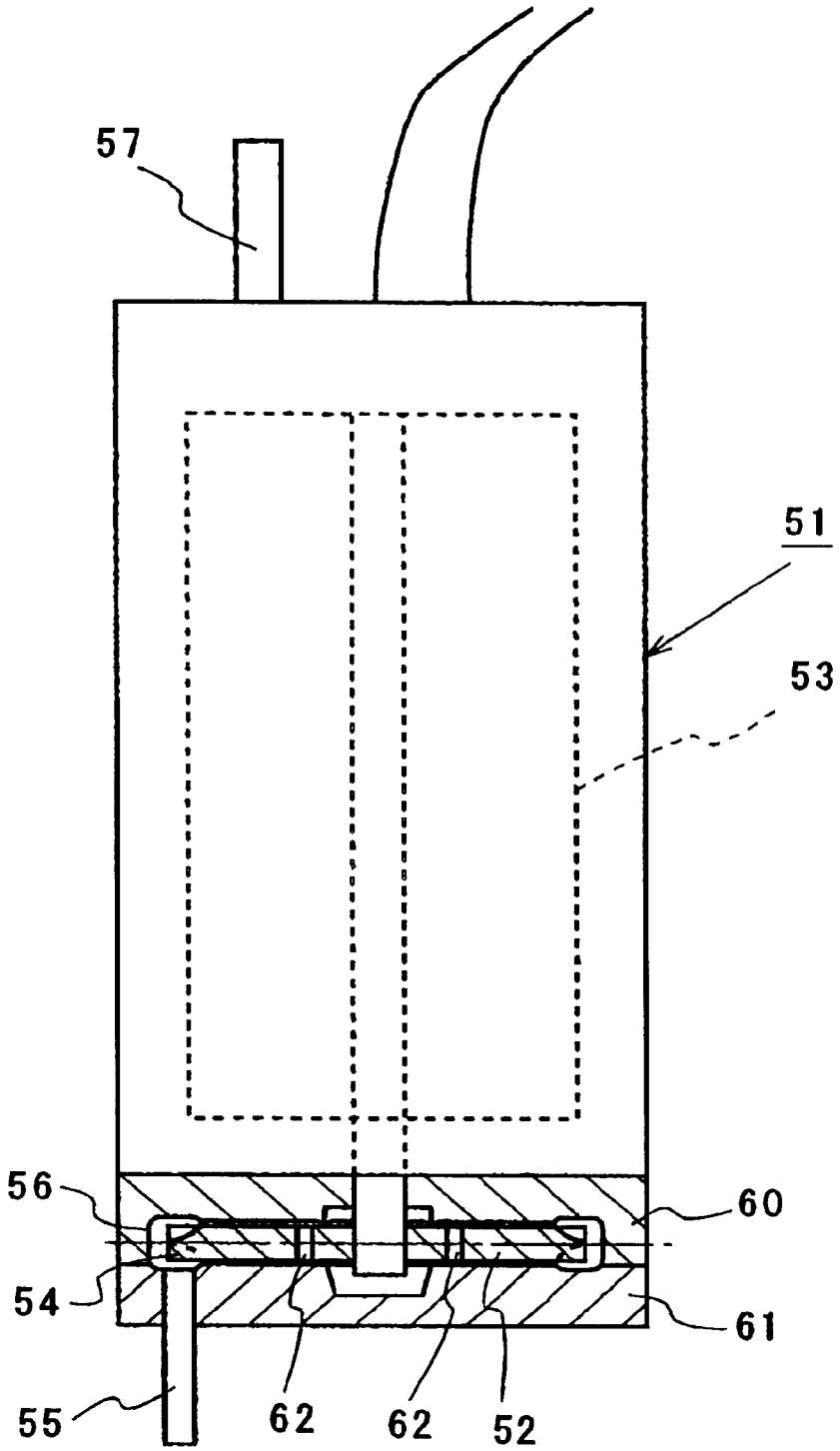
FIG. 17 PRIOR ART
FIG. 17 is a front elevational view showing a part of a conventional circumferential current pump in a broken manner.

FIGS. 15 and 16 are graphs showing a relation between a radius of the recess portion 14 in the injection molded impeller 7 and a pump performance, that is, a relation between a size of a seal portion S and the pump performance (refer to FIG. 2). In these drawings, a horizontal axis corresponds to a dimensionless amount expressed by a rate between a size (L) of the seal portion and a gap (2t) of the impeller side surface. Further, a vertical axis in FIG. 15 corresponds to a no-discharge pressure and a vertical axis in FIG. 16 corresponds to a discharge flow amount. In this case, in FIG. 2, in the case of setting a gap between one side surface 10 of the impeller 7 and the pump casing 4 to t1 and setting a gap between another side surface 11 of the impeller 7 and the pump cover 5 to t2, the sum (2t) of the gaps in both side surfaces 10 and 11 of the impeller 7 is expressed by a formula (2t)=(t1)+(t2). Further, in the case of setting a radius of the disc-like member 8 to R0, setting a radius of the disc-like recess portion 14 to R1 and setting a radial groove length of the vane groove 12 to H, the size (L) of the seal portion S is expressed by a formula (L)=(R0)−(H)−(R1). Further, P0 in FIG. 15 is a non-discharge pressure required for a fuel pump and V0 in FIG. 16 is a discharge flow amount required for the fuel pump.

Figure 18:
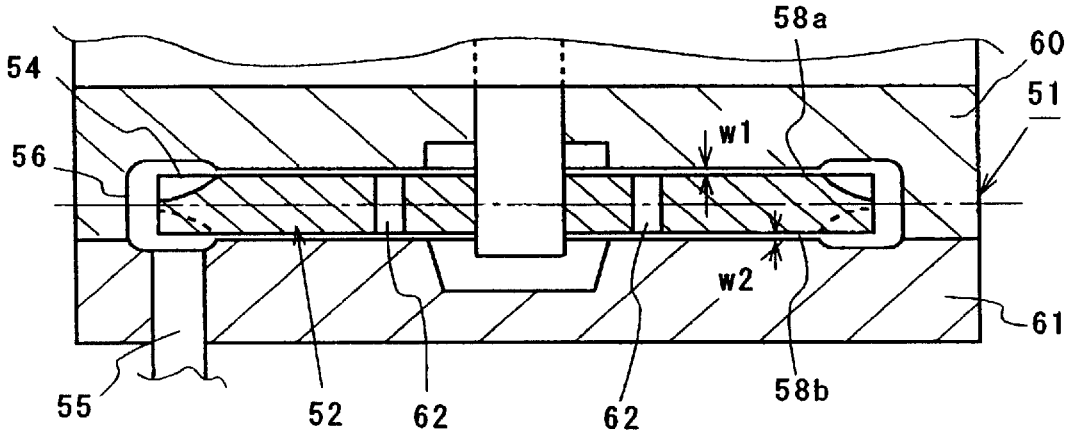
FIG. 18 PRIOR ART
FIG. 18 is a view showing a part of FIG. 17 in an enlarged manner.
Figure 19:
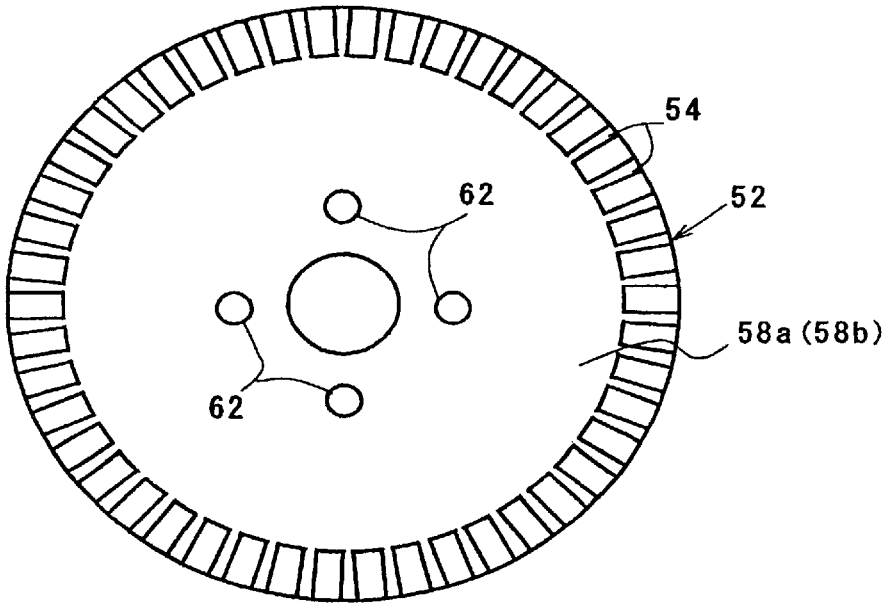
FIG. 19 PRIOR ART
FIG. 19 is a side elevational view of an impeller in accordance with a conventional embodiment.
Figure 20:
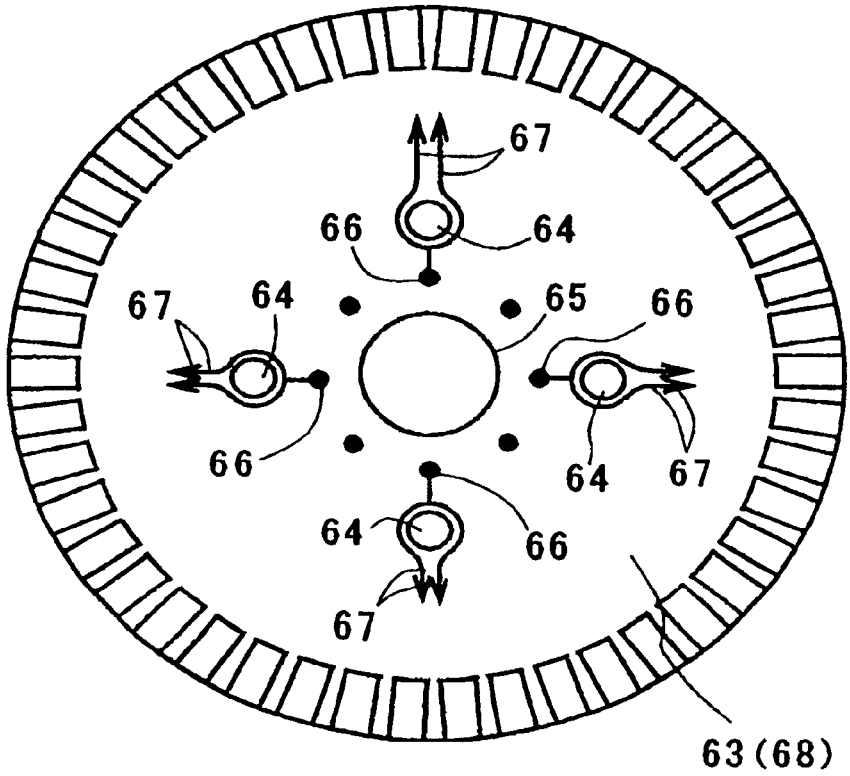
FIG. 20 PRIOR ART
FIG. 20 is a view showing a trouble (a weld phenomenon) generating state in accordance with the conventional embodiment.

That is, FIG. 15 shows a relation between the value (L/2t) and the non-discharge pressure. A fuel can be discharged to an engine side at a substantially constant non-discharge pressure (P0) by setting the value so as to satisfy a relation 66≦(L/2t). Further, FIG. 16 shows a relation between the value (L/2t) and the discharge flow amount. The fuel can be discharged at a substantially constant discharge flow amount (V0) by setting the value so as to satisfy the relation 66≦(L/2t) in the same manner as the relation between the value (L/2t) and the non-discharge pressure. Then, in accordance with the present embodiment, the sizes of the respective portions in the impeller 7 are set so as to satisfy a relation 66≅(L/2t). As a result, since it is possible to make the size L of the seal portion S in the impeller 7 in accordance with the present embodiment smaller in comparison with the conventional embodiment (refer to FIGS. 18 and 19) in which substantially all the area of the side surface 10 of the impeller 7 is set to a seal portion, it is possible to make the surface accuracy of the seal portion S higher. Accordingly, the injection molded impeller 7 can be used as it is without requiring a polishing. In this case, since the area of both side surfaces 58*a* and 58*b* of the impeller 52 is large and it is hard to mold both side surfaces 58*a* and 58*b* of the impeller 52 at a high accuracy in the conventional embodiment (refer to FIGS. 18 and 19), both side surfaces 58*a* and 58*b* of the impeller 52 are polished.

FIGS. 10 to 12 show a method of forming the impeller 7. As shown in these drawings, the structure is made such that a ring gate 20 for injecting a synthetic resin within a cavity 23 for forming the impeller is arranged in a portion corresponding to the annular recess portion 18 of the impeller 7. In this case, FIG. 12 shows an example of an injection molding metal mold 24, the injection molding metal 24 is a separated metal mold comprising an upper die 25 and a lower die 26, and the cavity 23 for forming the impeller is formed on a joint surface between the upper die 25 and the lower die 26. Further, the ring gate 20 mentioned above is formed in such a manner as to open to the cavity 23 in the upper die 25 side and the portion corresponding to the annular recess portion 18 in the impeller 7.

Figure 13:
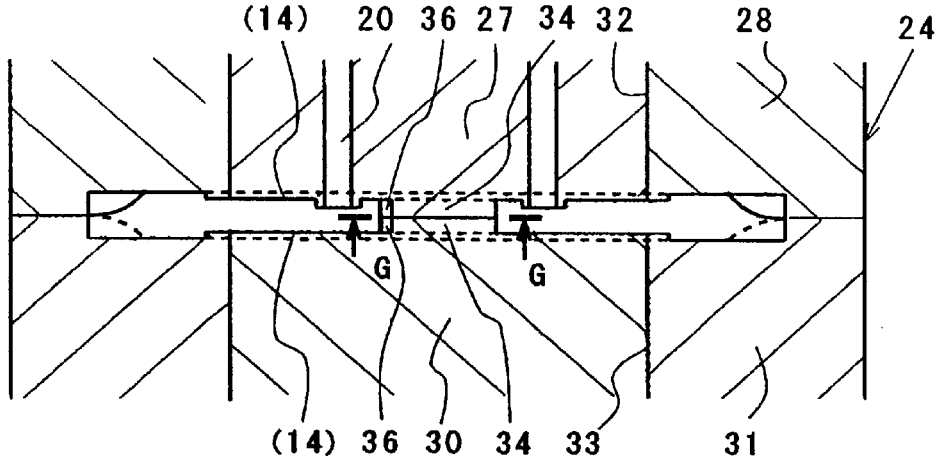
FIG. 13 is a cross sectional view showing a second example of the injection molding metal mold.

Further, FIG. 13 shows another example of the injection molding metal mold 24. The injection molding metal mold 24 is constituted by a first upper die 27 for forming the recess portion 14 in the side of one side surface 10 of the impeller 7, a second upper die 28 arranged in an outer peripheral side of the first upper die 27, a first lower die 30 for forming the recess portion 14 in the side of another side surface 11 of the impeller 7 and a second lower die 31 arranged in an outer peripheral side of the first lower die 30, a separation surface 32 between the first upper die 27 and the second upper die 28 and a separation surface 33 between the first lower die 30 and the second lower die 31 are positioned within the recess portion 14. Further, the ring gate 20 is formed in the first upper die 27 and in the portion corresponding to the annular recess portion 18 of the impeller 7.

As mentioned above, in accordance with the present embodiment, the separation surfaces 32 and 33 of the injection molding metal mold 24 are positioned in the recess portion 14 and the ring gate 20 is positioned in the annular recess portion 18, whereby a burr and a surface rough portion generated on the separation surfaces 32 and 33 of the injection molding metal mold 24 are received within the recess portion 14 and a burr and a surface rough portion generated on a released surface of the ring gate 20 are received within the annular recess.portion 18, so that the surface accuracy of both side surfaces 10 and 11 (the seal portion S) in the impeller 7 is not deteriorated and a disadvantage that the gaps (t1 and t2) in the side of both side surfaces 10 and 11 of the impeller 7 are increased is not generated.

Figure 14:
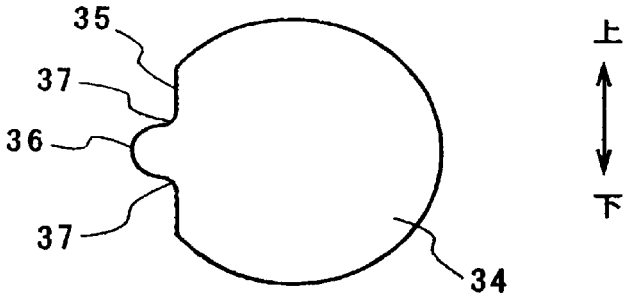
FIG. 14 is a view showing a plan shape of an axial hole forming portion of the injection molding metal mold.

FIG. 14 shows a shape of the mold for forming the axial hole 15 of the impeller 7 and is a view as seen from a direction F in FIG. 12 and a direction G in FIG. 13. As shown in FIG. 14, an axial hole forming portion 34 formed in the upper die 25 (the first upper die 27) and the lower die 26 (the first lower die 30) for forming the axial hole 15 of the impeller 7 is positioned at a substantially center portion of the upper die 25 and the lower die 26. Then, a pressure adjusting groove forming convex portion 36 for forming the pressure adjusting groove 17 is integrally formed in a rotation preventing portion forming portion 35 of the axial hole forming portion 34. The pressure adjusting groove forming convex portion 36 is positioned at a substantially center portion in a width direction (a vertical direction in FIG. 14) of the rotation preventing portion forming portion 35, a cross sectional shape thereof is formed in a substantially circular arc shape, and a corner portion 37 connected to the rotation preventing portion 16 is beveled in a circular arc shape.

As mentioned above, since it is unnecessary to independently place the pin for forming the pressure adjusting hole which is used in the conventional embodiment, within the cavity when the impeller 7 is formed by the injection molding metal mold 24 which is integrally provided with the pressure adjusting groove forming convex portion 36 in the axial hole forming portion 34, no weld phenomenon is generated and it is possible to make the structure of the injection molding metal mold 24 simple. Accordingly, the impeller 7 formed by the injection molding metal mold 24 mentioned above does not generate the surface roughness due to the weld phenomenon, it is possible to intend to reduce a cost for the metal mold, and it is possible to intend to reduce a producing cost.

Figure 3:
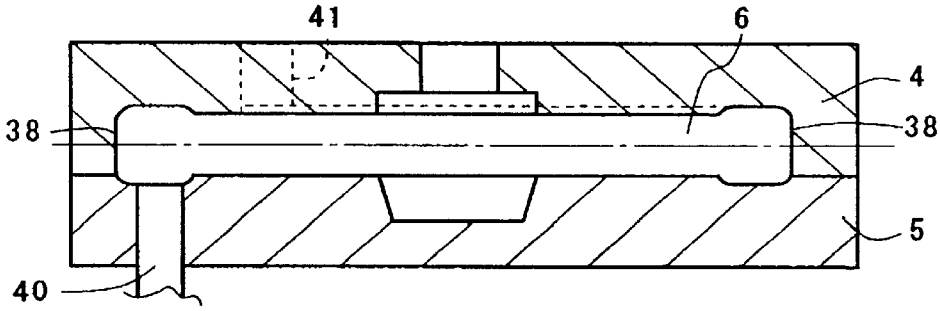
FIG. 3 is a cross sectional view showing a combined state between a pump casing and a pump cover.
Figure 4A:
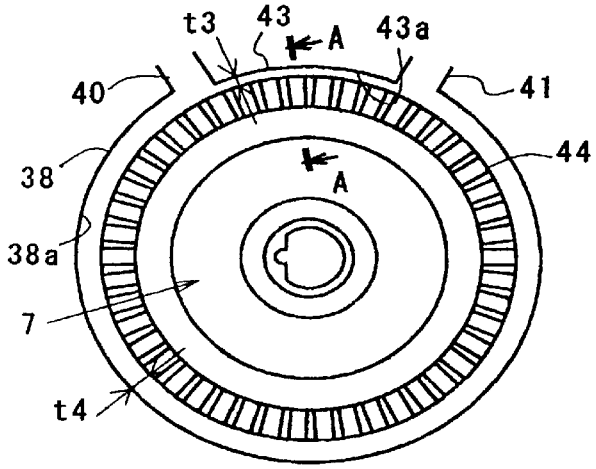
Figure 4B:
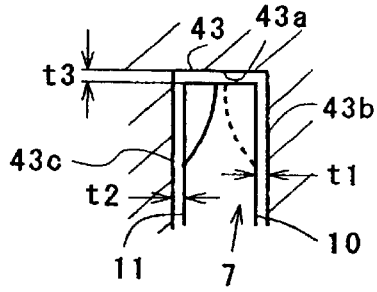
Figure 5:
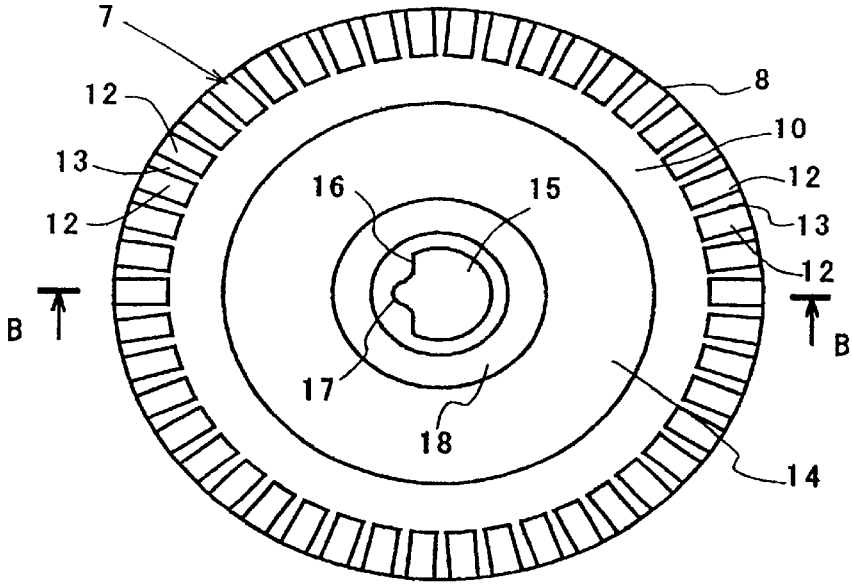
FIG. 5 is a top elevational view (a view as seen from an arrow C in FIG. 7) of an impeller.
Figure 6:
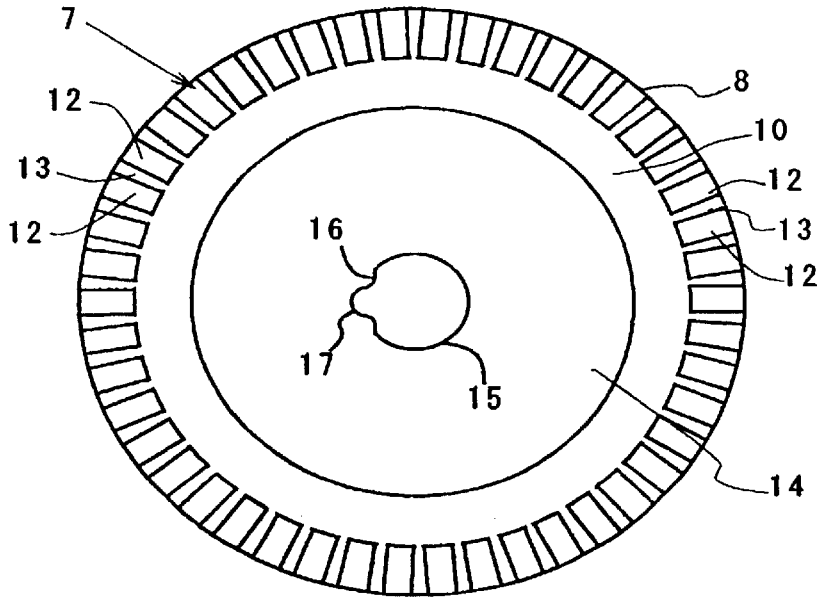
FIG. 6 is a bottom elevational view (a view as seen from an arrow D in FIG. 7) of the impeller.
Figure 7:
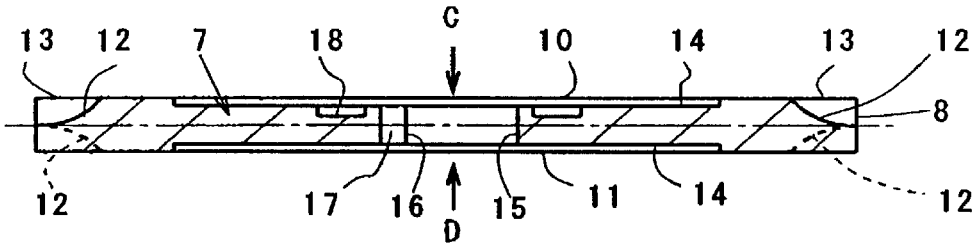
FIG. 7 is a cross sectional view along a line B—B in FIG. 5.
Figure 8:
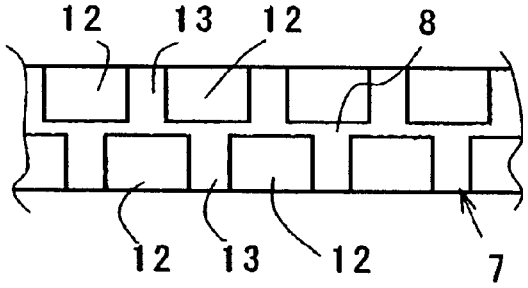
FIG. 8 is a view showing a shape of a vane groove as seen from an outer peripheral surface side of the impeller.
Figure 9:
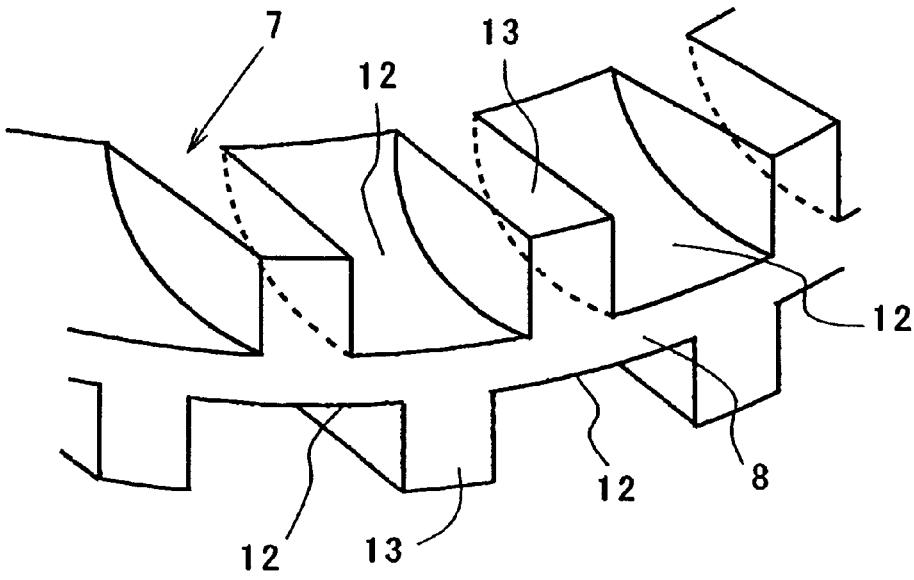
FIG. 9 is a perspective view partly showing an outer appearance of an outer peripheral end portion of the impeller.

FIG. 3 is a view showing a combined state between the pump casing 4 and the pump cover 5. Further, FIG. 4 is a schematic view showing a relation among a pump flow passage 38, a fuel inlet port 40, a fuel outlet port 41 and the impeller 7. As shown in these drawings, the substantially disc-like space 6 for rotatably receiving the impeller 7 is formed on the joint surface between the pump casing 4 and the pump cover 5. Further, the fuel inlet port 40 of the pump cover 5 and the fuel output port 41 of the pump casing 4 are communicated with the pump flow passage 38 formed in an outer peripheral side of the disc-like space 6.

In accordance with the present embodiment having the structure mentioned above, as shown in FIGS. 1 and 4, when the impeller 7 is rotated and driven by a motor 3*a* of the motor portion 3, the fuel within the fuel tank (not shown) flows into the pump flow passage 38 from the fuel inlet port 40. Then, the fuel flowing into the pump flow passage 38 from the fuel inlet port 40 receives an energy from the rotating impeller 7 and a pressure of the fuel is increased by the impeller 7 while moving to the fuel outlet port 41 along the substantially annular pump flow passage 38. Then, the fuel having a sufficiently increased pressure passes through a flow passage (not shown) of the motor portion 3 from the fuel outlet port 41 and is supplied to the engine (not shown) from a fuel discharge port 42.

In this case, as shown in FIG. 4, a partition wall portion 43 is formed between the fuel inlet port 40 and the fuel outlet port 41. A gap t3 between a peripheral surface 43*a* of the partition wall portion 43 and an outer peripheral surface 44 of the impeller 7 is set to be smaller than a gap t4 between a peripheral surface 38*a* of the pump flow passage 38 and the outer peripheral surface 44 of the impeller 7. Further, a gap between both side surfaces 43*b* and 43*c* of the partition wall portion 43 and both side surfaces 10 and 11 of the impeller 7 is set to a size equal to the gap size (t1 and t2) of the seal portion S in the impeller 7. That is, the gap in the side of the outer peripheral surface 44 of the impeller 7 and in the side of both side surfaces 10 and 11 is rapidly narrowed by the partition wall portion 43, whereby the fuel having the increased pressure is prevented from being leaked out to the fuel inlet port 40 side from the fuel outlet port 41 side. Further, the fuel within the pump flow passage 38 is prevented by the seal portion S of the impeller 7 from being leaked out inward in a radial direction.

As mentioned above, since the impeller 7 in accordance with the present embodiment is structured such that the pressure adjusting groove 17 is formed in the rotation preventing portion 16 of the axial hole 15 and it is unnecessary to independently place the pin for forming the pressure adjusting hole within the cavity 23, no weld phenomenon is generated and the impeller 7 can be used in a state immediately after the injection molding.

Further, in accordance with the present embodiment, as mentioned above, since it is unnecessary to independently place the pin for forming the pressure adjusting hole within the cavity 23 and the structure of the injection molding metal mold 24 is made simple, it is possible to intend to reduce a cost for the injection molding metal mold 24 and further it is possible to reduce a producing cost of the impeller 7.

Further, in accordance with the present embodiment, since the structure is made such that the annular recess portion 18 for arranging the ring gate 20 for injection molding is formed within the recess portion 14 formed on the side surface of the impeller 7, the burr is received within the annular recess portion 18 or the recess portion 14 even when the burr is generated at a time of releasing the ring gate 20, so that the surface accuracy of the side surface 10 is not deteriorated.

In this case, in the embodiment mentioned above, any pressure adjusting groove 17 may be employed as far as the pressure adjusting groove 17 is integrally formed with the axial hole 15 and communicates both side surfaces 10 and 11, for example, a substantially rectangular cross sectional shape or a substantially V-shaped cross sectional shape may be employed in addition to the substantially circular arc-shaped cross section.

Further, the pressure adjusting groove 17 is formed in the substantially center portion in the width direction of the rotation preventing portion 16, however, the structure is not limited to this, and the pressure adjusting groove 17 may be formed in a suitable portion within a range which does not damage a strength of the axial hole 15. In addition, a plurality of pressure adjusting grooves 17 may be formed.

Further, the radius (R1) of the recess portion 14 is not limited to each of the embodiments mentioned above and may be suitably set within a range $66 \leqq (L/2t)$ by taking the surface accuracy of the seal portion S into consideration.

Further, in each of the embodiments mentioned above, the recess portion 14 is formed on both side surfaces 10 and 11 of the impeller 7 in a symmetrical manner, however, is not limited to this and may be formed on at least one side surface of both side surfaces 10 and 11 of the impeller 7 as far as the required pump performance is satisfied. Further, the recess portion 14 may be formed in a nonsymmetrical manner as far as the radius (R1) of the recess portion 14 satisfies a condition $66 \leqq (L/2t)$.

Further, the present invention can be applied, for example, to an impeller in a side current type turbine pump disclosed in Japanese Unexamlned Patent Publication No. 9-79170 or a fluidized pump disclosed in Japanese Unexamined Patent Publication No. 10-89292.

As mentioned above, since the impeller in accordance with the present invention is structured such that the pressure adjusting groove is formed in the rotation preventing portion in the axial hole and it is unnecessary to independently place the pin for forming the pressure adjusting hole within the cavity, a deterioration of the surface accuracy on the impeller side surface on the basis of the weld phenomenon is not generated and it is unnecessary to polish, so that it is possible to intend to reduce a producing cost.

Further, in the impeller in accordance with the present invention, since it is unnecessary to independently place the pin for forming the pressure adjusting hole within the cavity and the structure of the injection molding metal mold is made simple, it is possible to reduce a cost for the injection molding metal mold, so that it is possible to reduce the producing cost of the impeller as well as the effect that the polishing is not required.

Further, the impeller in accordance with the present invention is structured such that the annular recess portion for arranging the ring gate for injection molding is formed within the recess portion formed on the side surface of the impeller, the burr is received within the annular recess portion or the recess portion even when the burr is generated at a time of releasing the ring gate, so that the surface accuracy of the side surface is not deteriorated.

What is claimed is:

1. An impeller for a circumferential current pump which is provided with a plurality of vane grooves in an outer peripheral side of a synthetic resin disc-like member to be rotated by a motor and is to be rotatably received within a substantially disc-like space formed between a pump casing and a pump cover, wherein an axial hole for engaging with a drive shaft of said motor is formed in a center portion of said disc-like member, said axial hole having an essentially D-shaped cross section and having a straight linear portion serving as a rotation preventing portion for engaging with a corresponding portion of said drive shaft so as to receive a drive force transmitted from said motor, and wherein a pressure adjusting groove open to both side surfaces of said disc-like member is formed at said rotation preventing portion of the axial hole.

2. An impeller for a circumferential current pump as claimed in claim 1, wherein an annular recess portion for arranging a ring gate for injection molding is formed at a position a predetermined spacing apart from an outer peripheral side of said axial hole.

3. An impeller for a circumferential current pump as claimed in claim 1, wherein said pressure adjusting groove is formed substantially at a center portion in a width direction of said rotation preventing portion.

4. An impeller for a circumferential current pump as claimed in claim 1, wherein a first annular recess portion for arranging a ring gate for injection molding is formed on one side surface of said disc-like member at a position a predetermined spacing apart from an outer peripheral side of said axial hole, and wherein said first annular recess portion is formed within a second larger annular recess portion formed on said one side surface of said disc-like member.

5. An impeller for a circumferential current pump as claimed in claim 4, wherein said second larger annular recess portion extends to open to said axial hole.

6. An impeller for a circumferential current pump, said impeller rotatably received within a substantially disc-like space which is defined between a pump casing and a pump cover, said impeller comprising:

a synthetic resin disc-like member which is to be rotated by a drive shaft of a motor;

a plurality of vane grooves which are formed in an outer peripheral portion of said disc-like member;

an axial hole which is formed in a central portion of said disc-like member, said axial hole having an essentially D-shaped cross section and having a straight linear portion serving as a rotation preventing portion which is engageable with a corresponding portion of said drive shaft so as to receive a drive force transmitted from said motor; and a pressure adjusting groove, formed in said rotation preventing portion of said axial hole, for adjusting pressure on both sides of said disc-like member, said pressure adjusting groove being open to both sides of said disc-like member.

7. An impeller for a circumferential current pump as claimed in claim 6, which further comprises an annular recessed portion which is to receive therein a ring gate for injection molding, said annular recessed portion being formed at a position a predetermined spacing apart from an outer periphery of said axial hole.

8. An impeller for a circumferential current pump as claimed in claim 6, wherein said pressure adjusting groove is formed in a substantially central portion of said rotation preventing portion.

9. An impeller for a circumferential current pump as claimed in claim 6, which further comprises:

a first annular recessed portion which is to receive therein a ring gate for injection molding, said first annular recessed portion being formed on one side of said disc-like member at a position a predetermined spacing apart from an outer periphery of said axial hole; and a second annular recessed portion formed on said one side of said disc-like member, said first annular recessed portion being formed in said second annular recessed portion.

10. An impeller for a circumferential current pump as claimed in claim 9, wherein said second annular recessed portion extends to open to said axial hole.

* * * * *